United States Patent [19]

Jesperson et al.

[11] Patent Number: 4,965,982

[45] Date of Patent: Oct. 30, 1990

[54] FRUIT BIN FILLER

[76] Inventors: Leslie S. Jesperson, 12204 Nelson Rd., Yakima, Wash. 98903; Bruce L. Jesperson, 101 Hovde La., Selah, Wash. 98942

[21] Appl. No.: 328,294

[22] Filed: Mar. 24, 1989

Related U.S. Application Data

[63] Continuation-in-part of Ser. No. 153,190, Feb. 8, 1988, Pat. No. 4,815,258.

[51] Int. Cl.[5] ..... B65B 1/04; B65B 5/10; B65B 39/00

[52] U.S. Cl. ..... 53/248; 53/245; 53/255; 198/839

[58] Field of Search ..... 53/245, 248, 251, 255, 53/260, 534, 536; 198/839

[56] References Cited

U.S. PATENT DOCUMENTS

| | | | |
|---|---|---|---|
| 1,987,916 | 1/1935 | Thompson . | |
| 2,668,651 | 2/1954 | Jansen . | |
| 2,827,082 | 3/1958 | Baum . | |
| 2,896,384 | 7/1959 | Carlsen et al. . | |
| 3,021,656 | 2/1962 | de Vries . | |
| 3,137,110 | 6/1964 | Boinnard . | |
| 3,147,846 | 9/1964 | Huntoon . | |
| 3,229,444 | 1/1966 | Rouse . | |
| 3,416,619 | 12/1968 | McClusky . | |
| 4,199,913 | 4/1980 | Hood et al. . | |
| 4,241,822 | 12/1980 | Molins et al. | 198/839 X |
| 4,250,690 | 2/1981 | Lorenzen et al. . | |
| 4,329,831 | 5/1982 | Warkentin et al. . | |
| 4,461,378 | 7/1984 | Roth | 198/839 X |
| 4,506,492 | 3/1985 | Boyd . | |
| 4,570,419 | 2/1986 | Tinsley . | |
| 4,815,258 | 3/1989 | Jesperson et al. . | |

*Primary Examiner*—Robert L. Spruill
*Assistant Examiner*—Linda B. Johnson
*Attorney, Agent, or Firm*—Foley & Lardner, Schwartz, Jeffery, Schwaab, Mack, Blumenthal & Evans

[57] ABSTRACT

An apparatus and method for loading delicate fruit into standard sized fruit bins is disclosed. The apparatus includes a carriage, a cradle, a distributing conveyor which are controlled to automatically lower fruit into a bin in such a way as to minimize damage to fruit and to maximize efficiency of loading. The distributing conveyor includes a twisted conveyor belt that gently guides fruit to a discharge opening as the fruit moves along the belt.

13 Claims, 6 Drawing Sheets

FRUIT BIN FILLER

CROSS-REFERENCE TO RELATED APPLICATION

The application is a continuation-in-part of U.S. Ser. No. 07/153,190, entitled "Fruit Bin Filler" by Leslie S. Jesperson et al., filed "Feb. 8, 1988, subsequently issued as U.S. Pat. No. 4,815,258 on Mar. 28, 1989.

BACKGROUND OF THE INVENTION

This invention relates to the field of agricultural product packing equipment and more particularly to devices adapted to efficiently pack delicate fruits and vegetables into containers with a minimum of bruising to the foodstuffs. More specifically, this invention concerns an automated device which receives delicate fruit from some external delivery means and then gently and gradually lowers the delivered fruit into a fruit bin until the bin is completely and evenly filled for subsequent storage or shipment.

A considerable problem with large scale packing of delicate agricultural foodstuffs is the bruising of individual fruits and/or vegetables in the process of grading, sorting and packing. It is well known that fruit or vegetables with even a small percentage of their surface area so bruised will not only deteriorate rapidly in quality themselves, but will cause surrounding fruits and/or vegetable to similarly deteriorate over time. As the deterioration time is not instantaneous, particularly when the foodstuffs are refrigerated, it is possible to pack for immediate shipment to market centers small quantities of fruit with some small degree of surface bruising without significant sacrifice of marketability of the delivered product. Any individual fruits or vegetables which arrive at the market in sufficiently damaged condition are simply discarded and there usually has not been time for the damaged fruit to cause deterioration to the rest of the fruit in the packing.

Large agricultural food products packing houses frequently receive large ungraded and unsorted quantities of a particular fruit or vegetable in season. Market demand is often not synchronized with nature's season. Through various well known methods and processes, the fruit or vegetables are graded and sorted inside the packing house. Those grades and kinds for which there is believed to be an immediate market are immediately packed and shipped to the market centers. However, there are usually one or more kinds of fruit in one or more grades of quality for which there is no immediate market, and these fruits and vegetables must be stored under refrigeration until the market is ready for them.

Sometimes these fruits and vegetables bound for storage are packed off the grading lines into small containers and refrigerated in order to minimize the problem of bruising the delicate food stuffs. However, packing into small boxes and storage in refrigeration is time consuming and expensive, particularly when most of the individual small boxes must later be opened and inspected for bruising and deterioration and then repacked into shipping containers when a market is eventually found for the product. It is the usual practice therefore to store the grades and kinds of fruit and vegetables for which there is no immediate market in large open bins in order to cut down on the costs of packing and repacking. However, methods of packing fruit and vegetables into large bins are none too gentle, with the result that considerable fruit and vegetables are damaged, become deteriorated, and cause the deterioration of surrounding foodstuffs in the bin. This results in substantial economic loss to the fruit crop.

Various solutions to the problem of packing delicate fruit such as apples or pears into large bin type containers have been attempted. One very expensive and cumbersome apparatus and method involves 80 foot long troughs of water into which the particular grade/sort of apple is unloaded followed by a mechanical transfer of the apples from the trough through a vertical column of water from beneath which the fruit bin is raised to collect the apples from the water. The water permits the apples to float in a cushioning medium but there are still a substantial percentage of bruises occurring, the apples must soak in the water for long periods of time which is not conducive to the highest standards of quality, the apparatus requires a very large room, and it is expensive to make and maintain. Several devices are known which automatically feed containers successively to a position beneath some kind of delivery ramp or chute so that the fruit is permitted to roll down the inclined side of the container to the bottom of the container, and then the container is gradually lowered to a position where the bottom of the container is horizontal when the box is near to filling. These devices are usually adapted to the use of the smaller cardboard type market shipping containers for fruit. The devices allow for varying degrees of droppage and collision of individual pieces of fruit with one another and operate at varying rates of efficiency in loading.

Several devices are adapted for filing round tub type containers to which is imparted a slow spin so that the fruit comes off a delivery ramp or conveyor of some sort and is deposited on the rotating mass of fruit in the bin. One such device employs a flexible ramp of length greater than the distance from the delivery conveyor to the surface of the collected fruit in an attempt to further cushion the delivery of the fruit to the bin. These devices still permit substantial bruising to occur and operate very slowly and inefficiently.

Still other devices permit the gradual collection of fruit by some collecting means above the eventual container in such a way that the collecting means is gradually lowered toward, and in one case partially into, the container, but when the collecting means has reached a predetermined state of fullness, the fruit within it is then permitted to roll out from the bottom of the collecting means and fall some substantial distance to the bottom of the container, thus permitting bouncing and bruising to occur. These devices also operate with less than optimum efficiency.

SUMMARY OF THE INVENTION

Accordingly, it is a general object of the invention to provide an apparatus and method for the rapid and efficient loading of fruit and vegetable containers of all sizes.

It is another general object of this invention to provide a method and apparatus which is not only fast and efficient in loading and packing delicate fruits and vegetables, but which is able to do so with an absolute minimum of bruising of the foodstuffs.

A further general object of the invention is to provide an apparatus which may be manufactured with standard components and with small tooling investment and which is, after manufacture, easy to maintain and operate.

It is a further object of this invention to provide method and apparatus for receiving at relatively high speed, from a large packing house sorting conveyor, large quantities of delicate fruit, and for rapidly and gently moving that delicate fruit by a succession of automated motions of the members of the apparatus, from the house conveyor into a fruit bin.

It is a further object of this invention to provide for the automatic replacement of full bins with empty bins so that the bin filling operation is continuous and requires only an occasional fork lift operator to remove full bins from the other end of the bin track.

It is a further object of this invention to provide a means of attaching a continuous roll of flexible sheeting material to the leading edge of the first bin to be filled at the start of the bin filling operation in such a way that the sheeting material is automatically drawn out by the successive motion of the bins and by the continual filling of fruit into bins thereby providing additional retarding action to the motion and rolling of the delicate fruit and providing some cushioning layer between the usually rough surface of such bins and the delicate fruit. Alternatively, the rolling of the fruit may be retarded by the presence of a drape means which overlays the fruit as it leaves the conveyor means, which drape means is retractable to avoid hindering the motions of the apparatus.

It is a still further object of this invention to provide means automating the bin filling operation through the use of electronic logic circuits and control elements in the form of micro switches and limit switches which may be optionally overridden by operator manual control. Alternatively, the automatic control maybe accomplished through the use of integrated circuits, microprocessors, electronic sensors, and other readily available computer components.

It is a still further object of the invention to provide an adjustable flow controlled, hydraulic system to slow down or speed up machine movements to suit the flow of fruit and to permit smooth operation of the hydraulic system when fruit flow is minimal.

These and other objects of the present invention which will become apparent from the following specifications are accomplished by means hereinafter described, the invention being measured by the appended claims and not by the details of the specifications.

The invention consists of method and apparatus which accomplish the above objectives in the manner further described below.

The apparatus of the invention comprises a bed and a upright tower, both of which may be made from any suitable structural material, such as steel tubing or other structural metals. In the preferred embodiment, standard grade structural steel tubing, angles, and channels are used. Obviously, any material suitable for other structural application may be substituted as appropriate for any particular application. When steel tubing is used as the structural material the preferred method of assembly is by welding, but any other means of connecting the individual structural members which allows for relative rigidity of construction will work as well. In the preferred embodiment the structural members which comprise the upright tower are not welded to the bed but are instead bolted so that the tower may be removed for folded downwardly in order to fit the apparatus through a confined entrance way onto the work site, where the tower is then fully extended and bolted into place in a relatively rigid fashion. The bed may rest upon a plurality of adjustable legs so that the bed may be easily leveled regardless of where it is installed. While it is not essential that the bed be operated in the level position, operation and maintenance of the apparatus are enhanced by a bed which is more or less level. Attached upon the bed are a pair of rails which are parallel to each other and spaced and adapted so that any standard size fruit bin can be slid along the track formed by the parallel rails. The rails may be adjustable for width to accommodate different size containers. The apparatus of the invention contemplates the use in the preferred embodiment of industry standard sized lug type fruit bins, each approximately three to four feet in width and length and approximately two to three feet in depth. Such bins are suitable and adapted for transportation by fork lift, typically made of plywood with three 4×4 runners on the bottom in parallel array and make use of steel reinforced plates at the corners and other stress points. These fruit bins are moved forward through the apparatus during the loading operation along the rails by any well known bin or pallet conveying means, such as conventional chain drive, conventional rollers, or as in the preferred embodiment by sliding along the rails with the mode of force supplied by a hydraulic cylinder and ram. Where cylinders are used in a particular embodiment, it is obvious that air cylinders may be used as well as cylinders operated by hydraulic fluid. For convenience all cylinders employed are double acting and are plumbed and controlled accordingly.

In the preferred embodiment a pair of U-channel steel members are placed in parallel array upon the bed with the open ends of the U facing each other and spaced apart to receive a rear shoe which is affixed to the end of the bins cylinders ram and which rear shoe rests upon cam follower type rollers which rollers ride within the parallel U and parallel and facing U channels. However, no particular ram tracking means need be used, and where one is deemed desirable any well known tracking means may be employed.

The tower is comprised of two parallel and facing U-channel members connected at the top by a top bar so that the open ends of the two U-channel members face one other. The tower is braced in a conventional manner when installed relatively rigidly upon the bed and the tower may be disposed to the bed at any suitable angle. In the preferred embodiment the tower is mounted substantially perpendicularly to the bed. Other cross sectional shapes of the upright frame members of the tower may be employed depending upon the design of the carriage as further described below.

A carriage is assembled of structure materials compatible to those employed in the tower and the bed, in the preferred embodiment the carriage is also comprised mostly of steel tubing. The carriage may be of any shape and structure so long as it is adapted to move vertically upwardly and downwardly upon the tower, or in the preferred embodiment within the rails formed by the parallel facing U-channels. The carriage may engage the tower for vertical movement of the carriage upwardly and downwardly by any well know means of sliding or rolling engagement, but in the preferred embodiment round steel cam followers are employed to roll within the channels of the upright frame members thereby insuring smooth and reliable upward and downward travel.

The carriage is moved upwardly and downwardly upon or within the frame work of the tower by one or more carriage movement means which, as described above for the bin moving means, may be any of several conventional carriage movement means, such as chain and sprocket, rack and pinion, pneumatic or hydraulic cylinder. In the preferred embodiment double acting hydraulic cylinders are employed. This carriage cylinder or cylinders may be mounted anywhere out of the way of the rotational movement of the cradle, as further described below, so long as they are adapted to move the carriage upwardly or downwardly under the influence of suitable controls.

A cradle means is rotatably attached to some portion of the carriage means in such a way that the axis of rotation of the cradle means is parallel to the plane of movement of the carriage means. In the preferred embodiment a roughly dihedral shaped cradle means is pivotally attached by means of rigid attachment to a pivot bar means which rotatably engages the carriage means at a plurality of bearing points. The conventional bearing means may be employed at these engagement points. The cradle means may be of open or closed structure, but in the preferred embodiment is an open structure of welded steel tubing. The cradle means comprising in addition a baffle means which may be padded or not, and which may be composed of any durable material which when attached or stretched across the open structure of the cradle means closes substantially all of the lower half of the lower plane of the dihedral of the cradle means and the dimension to insure that the width of the baffle means is substantially the same but slightly less than the width of the interior dimension of a standard food bin to be employed in the apparatus. The width of the cradle means must be less than the width of the interior dimension of the standard fruit bin to be employed, however the width dimension of the cradle means need only be such as to support the material chosen to be used for the baffle means. In the preferred embodiment the cradle means is several inches narrower than the standard fruit bin employed, and the baffle means is 11 gauge steel plate which is braked at the end by a 45 degree angle and padded with closed cell foam rubber on its forward and upward surface.

The carriage means is rotated about its rotational axis by any suitable cradle movement means, such as synchronous electronic drive, chain and sprocket or suitably placed cylinder and ram. In the preferred embodiment a double acting hydraulic cylinder is employed between some suitable lower portion of the carriage means and some upper portion of the cradle means so that when the cylinder is extended and retracted, the cradle means rotates about its rotational axis a maximum rearward position and a maximum forward position. In the preferred embodiment the axis of rotation to cradle means is coincident with the upper and forward edge of the upper plane of the dihedral of the cradle. The relative length of the open or closed dihedral face of the cradle means need bear no particular mathematical relationship to one another, although in the preferred embodiment the lower dihedral length is substantially longer than the upper dihedral length, so long as the positioning of the axis of rotation of the cradle means and the adjustment of the maximum downward travel of the carriage are coordinated to insure that the arc described by the forward lower tip of the baffle means as it rotates from its maximum forward position to its maximum rearward position does not interfere with the bottom or rear wall of the standard fruit bin.

The apparatus further comprises a conveying means to transfer the fruit to be packed into the bins from the grading and conveying system of the packing plant to the cradle and fruit bin of the apparatus of the invention. Typically, fruit to be packed arrives at the apparatus on the end of a conveyor belt from the sorting and grading apparatus in the packing plant. The fruit must then be conveyed by suitable means to the upper forward edge of the fruit bin with minimal bouncing and collisions with other fruit and with minimal velocity at the point of impact with the baffle means and the other fruit already upon the baffle or in the bin. In addition, the conveying means must be adapted to distribute arrival of the fruit more or less evenly across the upper forward edge of the fruit so that the bin automatically fills evenly from one side to the other. Ideally, some form of conveying means with a surface which moves across the front of the bin means and has the plane of its moving surface inclined from the horizontal and toward the forward edge of the fruit bin is employed.

In the preferred embodiment, an endless belt type conveyor belt means which may be mounted at an angle to the horizontal in a conventional fashion from the tower, is employed to convey the fruit across the front of the fruit bins as they are placed for filling. Since the conveying means lies perpendicular to the direction of travel of the bins as they are filled and pushed out of the apparatus, optimal clearance between the conveying means and the departing bin may be maintained while also maintaining a minimal height differential between a rearward edge of the moving belt surface and the forward upper edge of the bin by employing a conveying means, as in the preferred embodiment in which the returning portion of the belt loop is deflected upwardly to proximity of the forward moving portion of the belt loop by conventional rollers. Thus, fruit is deposited upon the conveying means at one end by the packing house conveyor, and the fruit then immediately rolls to the rearward edge of the conveyor belt while at the same time it is propelled forward across the front of the fruit bin.

As a means to minimize impact and damage to the fruit by collision as the fruit rolls across the conveyor belt to initially strike some channeling surface designed to prevent the fruit from spilling onto the floor, the initial impacting surface may be a short bumper conveyor belt means placed more or less perpendicularly to the distributing conveyor means with a belt surface moving in the same direction. Either or both conveyor belt means of the apparatus may be powered and driven by any well known conventional means such as electric motors, chain and sprocket or, as in the preferred embodiment, hydraulically driven motors from a hydraulic pumping source common to all of the hydraulic equipment of the apparatus.

To bridge the height differential between the upper moving surface of the distributing conveying means and the upper forward edge of the fruit bin, a shoe is employed which acts as a bridging delivery ramp spanning the width of the front edge of the bin. In the preferred embodiment the shoe is hingably mounted for rotation upon an axis substantially parallel with the rearward edge of the moving distributing conveying means for the purpose described herein.

In a further embodiment of the invention, the conveying means takes the form of a twisted conveyor assembly. The twisted conveyor assembly includes an endless conveyor belt that is wrapped around a horizontal roller and an inclined roller. The positional relationship of the inclined roller to the horizontal roller imparts a twist in the conveyor belt, causing fruit to be guided towards a discharge opening of the twisted conveyor assembly and into a fruit bin. A baffle is provided across the top surface of the twisted conveyor belt to aid in guiding the fruit towards the discharge opening as it is moved forward by the conveyor belt.

The apparatus may also employ means of retarding the flow of fruit down the slope of the fruit already deposited within the fruit bin such as the plastic sheet means and the drape means further described in the best mode.

The apparatus further comprises control means to coordinate and accomplish the rapid and gentle delivery of the fruit from the house conveying means into the apparatus of the invention and thence into the fruit bin. Although the apparatus is primarily referred to herein as an apparatus for the packing of delicate fruit, it is to be understood that the apparatus is equally suitable for the packing of delicate vegetables and other foodstuffs and also for the rapid and efficient packing of other less delicate species of fruits and vegetables. For ease of reference most references to the purposes and uses of the apparatus are made in the terms of delicate fruit. Any suitable automatic and logical control means may be employed to effect the sequence of motions necessary to accomplish the object of the invention. Also one control means and scheme is detailed below in the best mode consisting of microswitches, relays and hardwiring, it is too understood that other control means are also contemplated, such as microprocessor based computer like control means employing either microswitches or other motion and position sensing means which is now well known in the art or which may be developed in the near future as electronic technology continues to make its rapid advances. The essence of the control means is that it be adapted to accomplish the method of the invention, which is discussed further below.

The method of the invention is comprised of moving delicate fruit by a succession of automated motions of the members of an apparatus from the house conveyor and into a standard sized fruit bin. These automated motions are as follows: The fruit is received on an inclined distributing conveying means which then rolls and is carried to the forward edge of a bridging shoe means and rolls across that shoe means to the forward and upper edge of the fruit bin; there at the nominal starting position of a bin filling cycle the fruit meet a padded baffle means upon a cradle means. Fruit is permitted to build up at the intersection of the shoe means and the baffle means until fruit is evenly distributed across the front of the bin whereupon sensing means signal the cradle to begin lowering toward the bottom of the fruit bin at a rate of speed in proportion to the arrival upon the shoe of additional fruit by downward vertical motion to the carriage means upon which the cradle means is attached; when the forward lower baffle edge is substantially at the bottom of the fruit bin, the downward carriage travel ceases and the cradle is then rotated rearwardly in proportion to the arrival upon the shoe of additional fruit, until the cradle is fully withdrawn from the fruit at its maximum rearward position; thereafter with the bin now partially filled, the fruit will continue to arrive at the shoe and then roll down the slope of fruit into the filling bin which rolling may be retarded by the below described plastic sheet means or drape means. The uneven shape of fruit and the nature of piled objects will cause a build up at the rearward edge of the shoe of fruit in much the same fashion as that caused by the baffle so that build up on the shoe will continue to be sensed and after the cradle has been rotated rearwardly and the carriage then withdrawn upwardly to its maximum upward position with the cradle remaining in its rearward position, the continued arrival of additional fruit will signal the forward motion of the filling bin in order to dislodge the fruit building up along the rearward edge of the shoe down into the bin; the bin continues to travel under the conveyor and shoe in proportion to the arrival of the fruit until the rearward edge of the bin approaches the rearward edge of the shoe and the bin is nearly full; the cradle means is then rotated to its maximum forward position and by suitable mechanical linkages such as those described in the preferred embodiment the forward rotational motion of the cradle imparts an upward lifting motion to the shoe such that when the cradle means reaches its forward position and the carriage is in its maximum upward position, the shoe meet or overlap the forward lower edge of the baffle means, thereby cutting off the flow of all further fruit to the now full bin; when this condition is sensed, the bins are pushed forward so that a new empty bin takes its position with its forward edge beneath the lip of the rearward edge of the shoe; and when that condition is sensed, the carriage begins its downward motion once again which in turn causes the shoe to lower down its rearward edge to meet or overlap the forward upper edge of the bin and the bin filling cycle repeats again as long as there are bins to be filled and fruit to be packed.

BRIEF DESCRIPTION OF THE DRAWINGS

FIG. 5 shows plastic sheet; FIGS. 4 and 6 show alternative drape means, extended and retracted respectively.

DETAILED DESCRIPTION OF THE PREFERRED EMBODIMENTS

Figure 1:
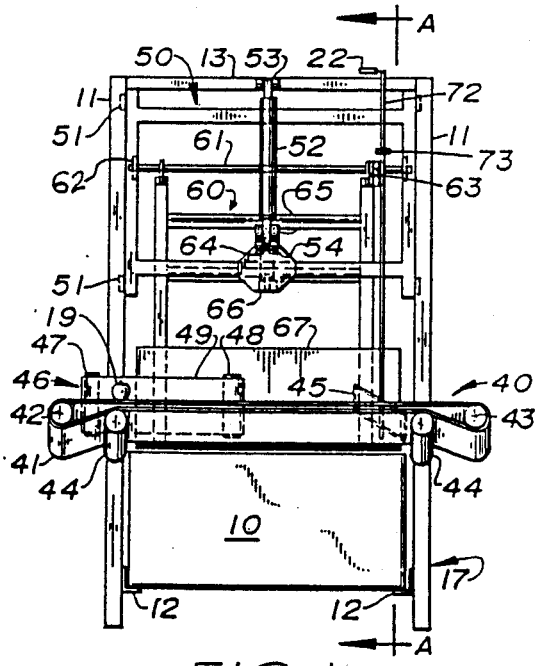
FIG. 1 is a front elevation of an embodiment of the bin loader apparatus viewed from the receiving end of the apparatus. Plastic sheet dispensing means or drape means is not shown in this figure.

Referring now to the drawings wherein like numbers indicate like parts, the invention is described in a preferred embodiment.

Figure 7:
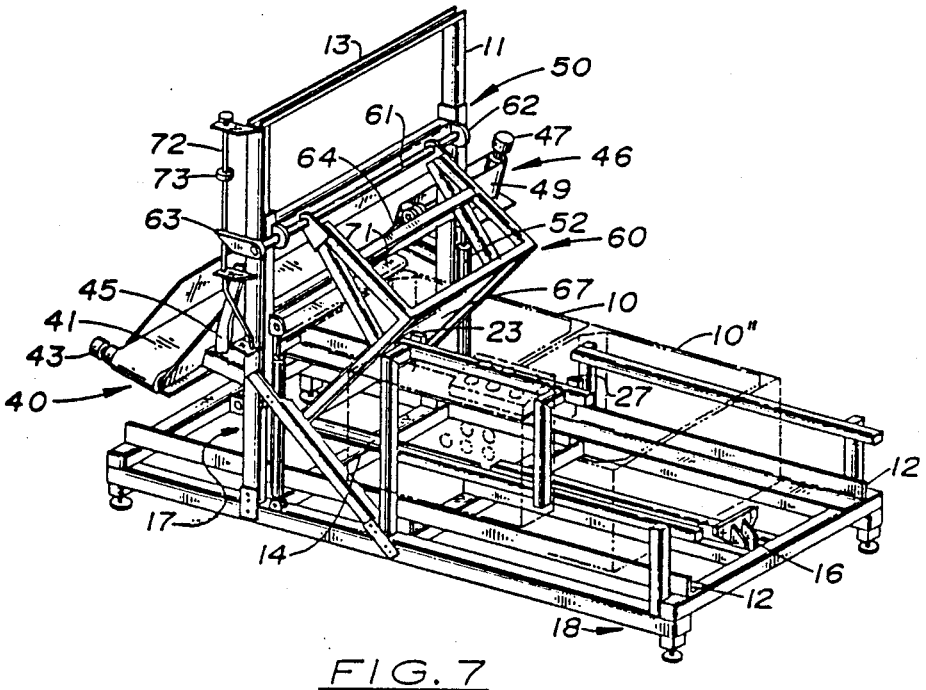
FIG. 7 is an isometric view of an alternative embodiment of the invention with positioning of some control elements omitted.

Referring to FIG. 7, the apparatus consists of a bed 18 adjustable for leveling by ordinary means, a tower 17 substantially perpendicular to bed 18, a carriage 50 which is adapted to travel upwardly and downwardly upon or within the frame of tower 17, a cradle 60 pivotally mounted at a point upon carriage 50 for rotation thereabout, distributing conveyor 40 to receive fruit from the packing house grading conveyor and distribute the fruit across the front of a fruit bin, and various control means and means to move carriage, cradle, bins and conveyor belts, detailed herein.

The structural components of the apparatus are welded together by a well known means from stock sizes and grades of tubular, angle, and U-channel steel stock in conventional fashion. Tower 17 may be bolted to bed 18 and braced in such a way that tower 17 may be removed or folded for easier installation through confined entrance ways. Bed 18 is constructed and arranged of structural members in a conventional manner and upon the bed are attached two angle iron rails 12. The rails are parallel and spaced to accept for sliding fit standard sized fruit bins.

The fit of a standard fruit bin within the rails is illustrated in FIG. 1. Erected vertically from rails 12 and bed 18 of the apparatus are two upright frame channel members 11 which are connected at the top by a top bar 13 which together with conventional bracing comprise tower 17. Upright frame channel members 11 are made of U-channel stock disposed in the apparatus so that the open side of the U on each channel member faces inwardly toward the other.

In FIGS. 1–6 these upright framed channel members 11 serve to guide the vertical up and down motion of carriage 50 whose carriage rollers 51 ride within the open space of upright frame channel members 11. In an alternative embodiment, generally shown in FIG. 7, two set of rollers are provided, the second set of which roll upon the bottom of the U, as opposed to the sides of the U. Carriage 50 is thus disposed to be moved upwardly and downwardly by the action of carriage cylinder 52, which like all cylinders in the preferred embodiment, is a double acting hydraulically actuated cylinder whose hydraulic fluid is supplied by well known hydraulic pumping means and plumbing. Carriage cylinder 52 is attached at carriage cylinder upper mount 53 to top bar 13, and at carriage cylinder lower mount 54 to a lower portion of the carriage as shown in FIG. 1. In FIG. 7, there are shown two carriage cylinders 52, and they are mounted along side the parallel to upright channel members 11, and they are attached to bed 18 and a lower position of carriage 50 upon either side of the apparatus. Thus when the ram of carriage cylinder 52 in FIGS. 1–6 is extended by hydraulic action the carriage is in turn driven downward; similarly when the ram of carriage cylinder 52 is retracted by opposite hydraulic action, carriage 50 is drawn upward. Carriage 50 is shown in the extreme upward position in FIGS. 1, 2, 5 and 6.

Figure 2:
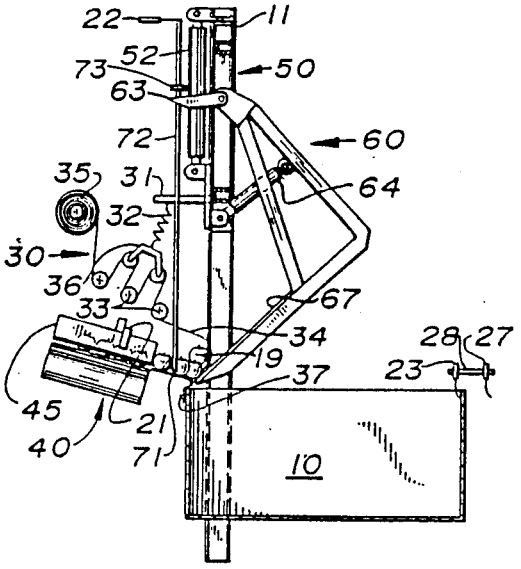
FIG. 2 is a partial side elevation of the bin loader apparatus of FIG. 1 drawn in partial section taken along line A—A of FIG. 1 in the beginning of the loading cycle. Common structural elements of the tower and bed and of the bumper conveyor are not shown in this or in FIGS. 3–6. Plastic sheet dispensing means is shown in mid section, side elevation.

Pivotally attached to carriage 50 at pivot bar bearings 62 is a cradle 60 by way of cradle pivot bar 61. Cradle 60 is rotated backward and forward so as to be at least partly positionable within bin 10 about the axis of pivot bar 61 by the double hydraulic action of cradle cylinder 64 which is attached at cradle cylinder lower mount 66 to a lower portion of carriage 50, and at cradle cylinder upper mount 65 to a rearward portion of cradle 60, as illustrated in FIGS. 1 and 2. When viewed from the front as in FIG. 1 it can be seen that the dimensions of the structural network of cradle 60 are in general narrower than those inner dimensions of the standard fruit bin 10. As clearly shown in FIGS. 2 and 3, cradle 60 comprises a first member attached at one end thereof to the carriage 50 and a second member fixedly secured at the other end thereof. The second member extends at an angle from the first member, and its portion remote from the first member forms a lower forward portion of the cradle 60. However the lower forward portion of cradle 60 is spanned by attached padded baffle 67 whose width as viewed in FIG. 1 across the front is substantially the same as the width of the inside of a standard fruit bin. Cradle pivot bar 61 has adjustably attached to it arm 63 such that the motion of the forward tip of arm 63 is controlled by the rotation of cradle 60 and is both proportional and co-directional with the rotation of cradle 60. Baffle 67 is made of 11 gauge steel sheeting to which is bonded a padding layer of a conventional closed cell foam such as grey "poron" tin of 3/16 inch thickness on the forward facing surface of baffle 67. In an alternative embodiment, shown in FIG. 5A, the steel sheeting of baffle 67' has an extension 68 created by a 45 degree brake at the lower edge of baffle 67 which projects relatively forwardly and downwardly from the lower edge of baffle 67' and cradle 60. This extension 68 aids in preventing pinching of the fruit between baffle 67 and the inside front wall of bin 10.

Figure 3:
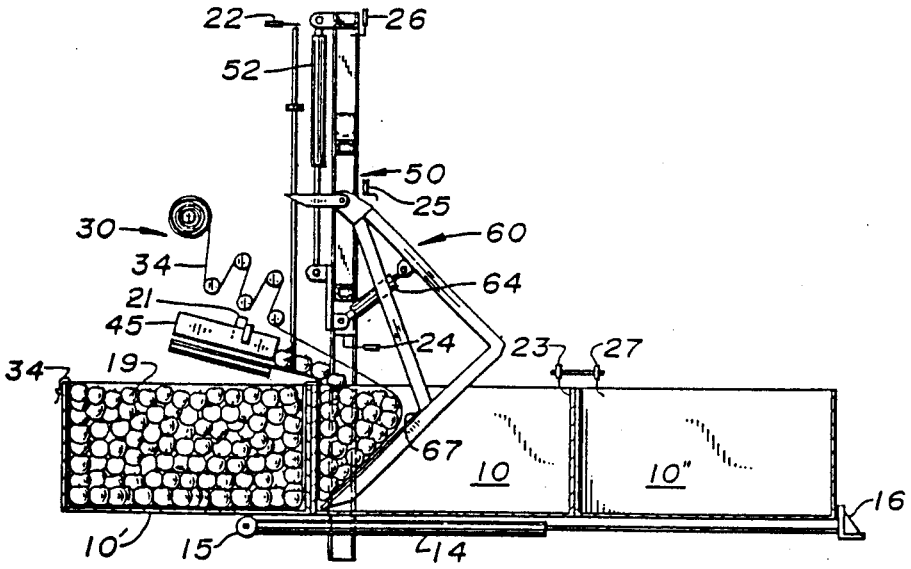
FIG. 3 is a further side elevation illustrating bin cylinder and the arrangement of three bins upon the bed as they progress through the bin loading apparatus. Plastic sheet dispensing means is shown in mid section, side elevation.

Both as a part of the filling operation, and as each bin is successively filled, bins 10, 10' and 10'' are moved forward by the action of bin cylinder 14 which is also hydraulically double actuated in the preferred embodiment. Bin cylinder 14 is mounted at bin cylinder forward mount 15 to some suitable forward portion of the framework of bed 18 and bin cylinder rear shoe 16 at the end of bin cylinder 14 ram is slidably supported within parallel and opposed 11 channels contained within bed 18 generally shown in FIG. 7. As the ram of bin cylinder 14 is retracted forward pressure is exerted on bin 10'' as shown in FIG. 3 to advance all bins in line in a forward direction. As each successive full bin reaches position 10' the bin can be off loaded by any of several well known methods, including fork lift or gravity or power roller system. As bins in position 10'' are moved forwardly into position shown by bin 10 in FIG. 3 a vacant space is created into which a new bin 10'' is dropped by auxiliary convention chain drive bin moving conveyor. It is to be understood that bin cylinder 14 forms a part of the apparatus in all preferred embodiments but is omitted from illustration in other figures for ease of illustration.

Figure 4:
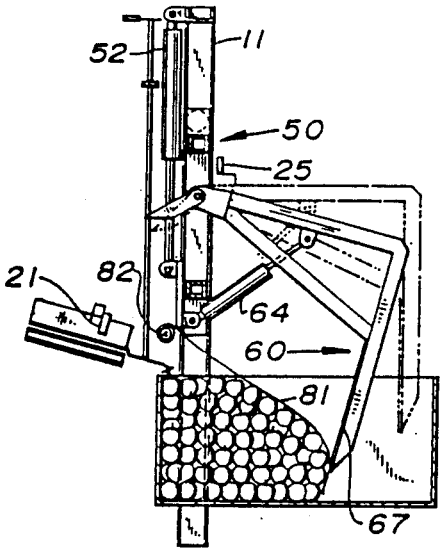
FIGS. 4, 5 and 6 and are additional side sectional elevations showing varying positions of carriage, cradle and bins to complete the loading cycle.
Figure 5A:
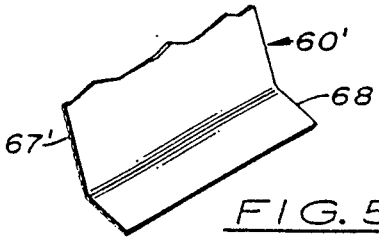
FIG. 5A is a detail section of an alternative embodiment of the lower forward tip of the cradle.
Figure 5:
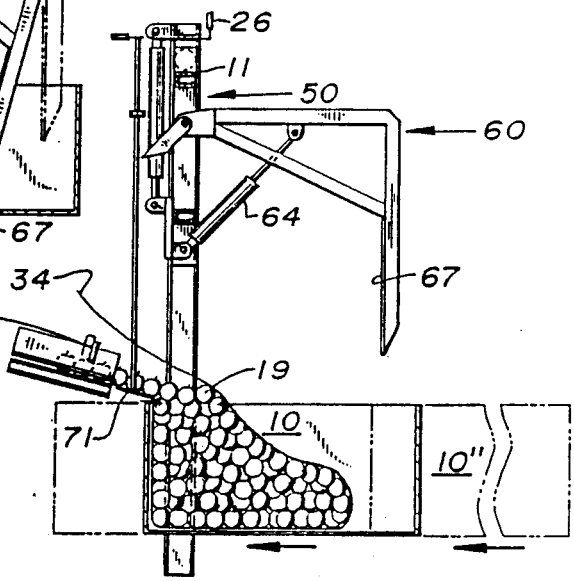

Similarly for reasons of ease of illustration, plastic sheet dispensing means 30 is illustrated in FIGS. 2, 3 and 5 but not in other figures. Plastic sheet dispensing means consists of a plastic sheeting roll 35 conventionally mounted upon tower 17 (not illustrated), tensioning rollers 33, spring hanger 31, tension spring 32 and roller yoke 36. Plastic sheet 34 comes off of plastic sheeting roll 35 and is woven through tensioning rollers 33 and fed, at the start of filling operations for any particular day or shift, along the upper surface of shoe 71 down through the gap between shoe 71 and baffle 67, and stapled to the forward upper edge of bin 10 by staple 37, as illustrated in FIG. 2. Thereafter the motion and weight of fruit 19 as each bin is progressively filled off of distributing conveyor 40 causes the plastic sheet 34 to unroll under tension from plastic sheeting roll 35 as selectively and representatively illustrated in FIGS. 2, 3 and 5. As each bin becomes full of apples, it also becomes lined with a plastic sheeting over forward and rear walls and floor of bin 10. When the full bin is ready to leave position 10, as illustrated in FIG. 3, the plastic sheeting protection between successive bins caused by the successive filling of the bins with apples and the continual unrolling of plastic sheet 34 is simply torn or cut in order to separate the individual bins for movement from the apparatus. Plastic sheeting 34 serves somewhat to cushion the fruit from friction with the rough interior surfaces of the standard fruit bin and also serves to slow the cascading motion of fruit that comes into the bin off of the distributing conveyor 40, particularly when cradle 60 is in its rearward or upward positions as illustrated in FIGS. 4 and 5 during the portion of the cycle when the bins are being advanced forwardly. As the bins are advanced forwardly, as illustrated in FIGS. 4 and 5, the resulting decrease in tension of the plastic sheeting is taken up by natural retraction of tension spring 32 acting upon roller yoke 36 to raise tensioning rollers 33 and so take up the slack in plastic sheet 34.

Figure 6:
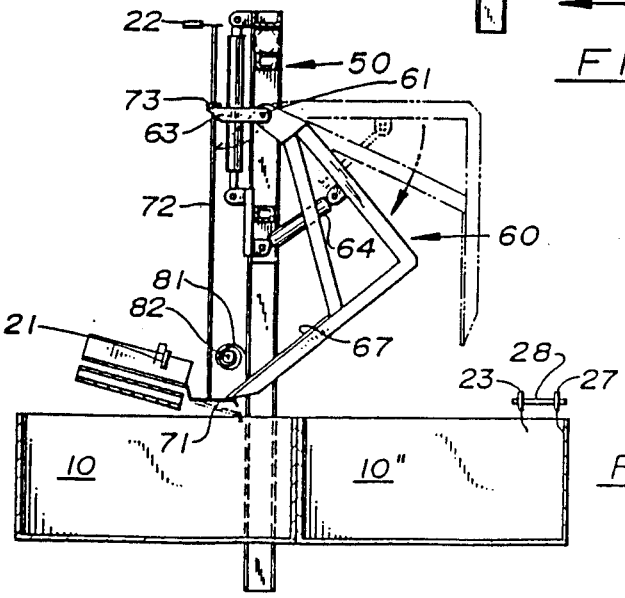

In an alternative embodiment represented in FIGS. 4 and 6, a drape 81 hangs from drape roller 82 which is conventionally mounted to tower 17 (mounting not illustrated). Drape 81 serves to retard the rolling and cascading motion of arriving fruit as shown in FIG. 4 by laying upon the arriving fruit and adding soft friction to reduce the speed and avalanche effect of the fruit as bin 10 advances to the position of bin 10'. In FIG. 6, drape roller 82 and drape 81 are shown in retracted position at the end of the loading cycle when shoe 71 and baffle 67 are in substantial overlapping contact which would otherwise entangle drape 81. Convention tapered hub end cable design are employed to retracted drape roller 82, with the cable attached over suitable pulley means to the end of bin cylinder 14 ram.

The apparatus is positioned so that fruit 19 is delivered to distributing conveyor 40 at the forward left portion of conveyor belt 41 as viewed in FIG. 1. As shown in FIG. 1, distributing conveyor 40 has a conventional continuous conveyor belt 41 driven by driving roller 43 which is powered by conventional hydraulically driven motor (not illustrated). Conveyor belt 41 is raised by idlers 44 on its under travel to within an inch of the lower surface of upper travelling belt 41. This facilitates the lowest possible positioning of distributing conveyor 41 to reduce the drop of fruit 19 to bin 10, while still permitting clearance of bin !0 under conveyor 40 as bin 10 moves to bin position 10, Fruit may be delivered to the apparatus upon distributing conveyor 40 by any well known packing house means, such as by overlapping conveyor. The plane of conveyor belt 41 is inclined to the horizontal roughly as shown in FIG. 2–6, and bin 10 moved to bin position 10'. Fruit 19 rolls down the incline of distributing conveyor 40 from the forward edge to the rearward edge of conveyor belt 41, most often encountering bumper conveyor 46 shown in FIGS. 1 and 7, so that fruit 19 is conveyed to the end of conveyor belt 49 with a minimum of rolling and bouncing of the fruit. When the fruit reaches the end of conveyor belt 49 and while it is still rolling on the lower rearward edge of conveyor belt 41, it rolls under the influence of gravity off of belt 41 and across shoe 71 and into contact with baffle 67 of cradle 60 at the beginning of the loading cycle, as shown in FIG. 2. Additional fruit 19 beginning at the same location as shown in FIG. 1 also rolls rearwardly to bumper conveyor 46 and is propelled to the right to the end of conveyor belt 49 and down across shoe 71 to baffle 67. As fruit begins to accumulate on the line of intersection of shoe 71 and baffle 67, where, in the initial stages of the cycled movements of the apparatus, the fruit can go no further, and also later when the fruit already loaded into the partially full bin prevents the further movement of arriving fruit, fruit 19 begins to build up on distributing conveyor 40 as shown in FIG. 2, and the built up fruit mass advances rightwardly toward screed 45 which is angled both to the right as shown in FIG. 1 and downwardly at the same angle of incline as conveyor belt 41. Fruit 19 which reaches screed 45 is thus shunted off of conveyor belt 41 and onto shoe 71, until at an adjustably determined point the quantity of fruit which is backed up on shoe 71 and conveyor belt 41 is such that a piece of fruit eventually strikes microswitch 21 mounted upon screed 45 and illustrated in FIGS. 2–6 but not, for ease of representation, in FIGS. 1 or 7. By adjusting the position and sensitivity of microswitch 21, the fruit buildup on shoe 71 serves to cause fruit 19 to be loaded into bin 10 evenly across the entire front edge of the bin.

There is a cyclic pattern of motion to the moving members of an apparatus during the loading operation of a fruit bin. For example, a nominal starting position as illustrated in FIG. 2, where bin 10 has just been advanced to its initial filling position and the rear wall of bin 10 has just activated microswitch 23 causing carriage 50 to begin its decent and shoe 71 to thereby drop into the position illustrated in FIG. 2, fruit is delivered upon distributing conveyor 40 and rolls under the influence of conveyor belts 41 and 49 and gravity onto and across shoe 71 to lay in contact with padded baffle 67. Successively arriving fruit builds up on shoe 71 and baffle 67 until fruit builds up on conveyor belt 41 and eventually a piece of fruit comes into contact with microswitch 21 which at this stage serves to actuate carriage cylinder 52 to extend its ram downward which in turn causes carriage 50 and cradle 60 to descend into bin 10 with a load of fruit upon baffle 67. The rate of arrival of fruit 19 upon distributing conveyor 40 and the positioning and sensitivity of microswitch 21 determine the length of time interval between successive strikings of microswitch 21 by fruit 19 and the resultant actuation of carriage cylinder 52. Movement may thus be either incremental in appearance or may approach continuous motion.

Fruit arriving upon distributing conveyor 40 continues to activate microswitch 21 which continues to cause carriage cylinder 52 to extend its ram driving carriage 50 and cradle 60 downwardly into bin 10 until the lowermost forward portion of baffle 67 is nearly in contact with the floor of bin 10, as illustrated in FIG. 3. At this point, microswitch 24 which is positioned in some suitable stationary location such as upon upright frame channel member 11 by conventional means, is activated by contact with some suitable portion of descending carriage 50 as illustrated for example in FIG. 3. Microswitch 24 causes carriage 50 to descend no further and signals successive fruit 19 contact with microswitch 21 to activate cradle cylinder 64. The extension of cradle cylinder 64 causes cradle 60 and its baffle 67 to rotate rearwardly with each successive fruit contact with microswitch 21 to positions such as those illustrated in FIG. 4. Each successive movement of carriage 50 downwardly, as in FIGS. 2 and 3, opens more space in the bin to receive additional fruit 19, just as each successive rotation of cradle 60 and baffle 67 rearwardly also creates additional space in bin 10 for successively arriving fruit 19.

When cradle cylinder 64 has extended its ram to the maximum due to successive contacts of fruit with microswitch 21, cradle 60 will have moved from the position illustrated in FIG. 4 by unbroken lines to the position illustrated by the broken lines in FIG. 4 where some suitable portion of cradle 60 will make contact with microswitch 25 mounted on some suitable portion of carriage 50 or alternately upper right frame channel member 11. Contact of cradle 60 with microswitch 25 causes carriage cylinder 52 to immediately retract continuously without regard to impulses from microswitch 21 until carriage 50 and cradle 60 are in a position illustrated by FIG. 5, whereupon some suitable portion of carriage 50 comes into contact with microswitch 26 mounted upon some suitable portion of upright frame channel member 11, as illustrated in FIG. 5.

The signal from microswitch 26 then causes successive fruit 19 contacts with microswitch 21 to actuate bin cylinder 14 to move bin 10 and 10'' forward in the direction of the broken arrows illustrated in FIG. 5. Although cradle 60 is now entirely out of the way of arriving fruit, successively arriving fruit continues to build up beyond the lower edge of shoe 71. The imperfectly round fruit causes build up at the forward end of the filling bin also as illustrated in FIG. 5 as it resists rolling into bin 10. Thus microswitch 21 continues to be struck by arriving fruit and bin cylinder 14 continues to advance bin 10 to cause built up fruit to roll into bin 10 under its own weight. Plastic sheet 34 or alternatively, drape 81, continues to act to cushion and retard the spilling movements of the fruit 19 which would otherwise have a greater tendency to cascade or "avalanche" down the slope of filling fruit toward the floor of bin 10. When successively arriving fruit and its contact with microswitch 21 have caused bin cylinder 14 to move bin 10'' from its dotted position in FIG. 5 to its position in FIG. 6, it can be seen that the fruit in bin 10 of FIG. 6 will have almost entirely filled bin 10. See bin 10' in FIG. 3. At this point, the rearward wall of bin 10'' makes contact with microswitch 27 mounted upon some suitably positioned adjustably mounted bar 28. The signal from microswitch 27 causes cradle cylinder 64 to fully retract thereby rotating cradle 60 in FIG. 6 from the position illustrated by a broken line to the position illustrated by unbroken lines as suggested by the dotted curved arrow in FIG. 6. Concurrently arm 63 is caused to rotate upwardly from the position in FIG. 6 illustrated with dotted lines to the position illustrated with unbroken lines by the rotation of cradle 60 through cradle pivot bar 61. This upward rotation of arm 63 when carriage 50 is in the extreme upward position, as illustrated in FIG. 6, causes arm 63 to come into contact with rod dog 73 which is adjustably attached to shoe rod 72 in such a way that the rotation of arm 63 is translated through shoe rod 72 to shoe 71 whereby shoe 71 is moved from the position illustrated by dotted line in FIG. 6 to the position illustrated by the unbroken line. This raises shoe 71 so that its rearward edge comes into contact with the forward edge of baffle 67 and cuts off thereby any further flow of fruit into bin 10. In an alternative embodiment, shoe 71 is overlapped at this stage by an extension 68 of baffle 67' (FIG. 5A).

The upward motion of shoe rod 72 caused by arm 63's contact with rod dog 73 moves the upper end of shoe rod 72 into contact with microswitch 22 suitably mounted upon some upper portion of upright frame channel member 11 or top bar 13. The signal from microswitch 22 activates bin cylinder 14 without regard to signal from microswitch 21, to advance bins 10 and 10'' as illustrated in FIG. 6 in a forward direction until the rearward wall of bin 10'' contacts microswitch 23 just as bin 10'' in FIG. 6 moves into the position of bin 10 illustrated in FIG. 2. Alternatively, microswitch 22 may be eliminated and the signal from microswitch 27 can be used both to ultimately cut off the flow of fruit into bin 10 as described above, and also to cause bin cylinder 14 to advance the bins until the rearward wall of bin 10'' in FIG. 6 contacts microswitch 23. This is the fill/start position, bin 10 newly arrived in its position with its rearward wall in contact with microswitch 23, and the signal from microswitch 23 directs signals from micro switch 21, now continuously signaling due to the backup of fruit on shoe 71, baffle 67 and conveyor belt 41, so that carriage cylinder 52 once again begins to extend and drive cradle 60 and baffle 67 downwardly toward the bottom of bin 10. The cycle then repeats for as long as there is fruit being delivered onto distributing conveyor 40 and there are sufficient empty boxes to continue to allow bin cylinder 14 to drive forward bins into contact with micro switches 23 and 27.

Figure 8:
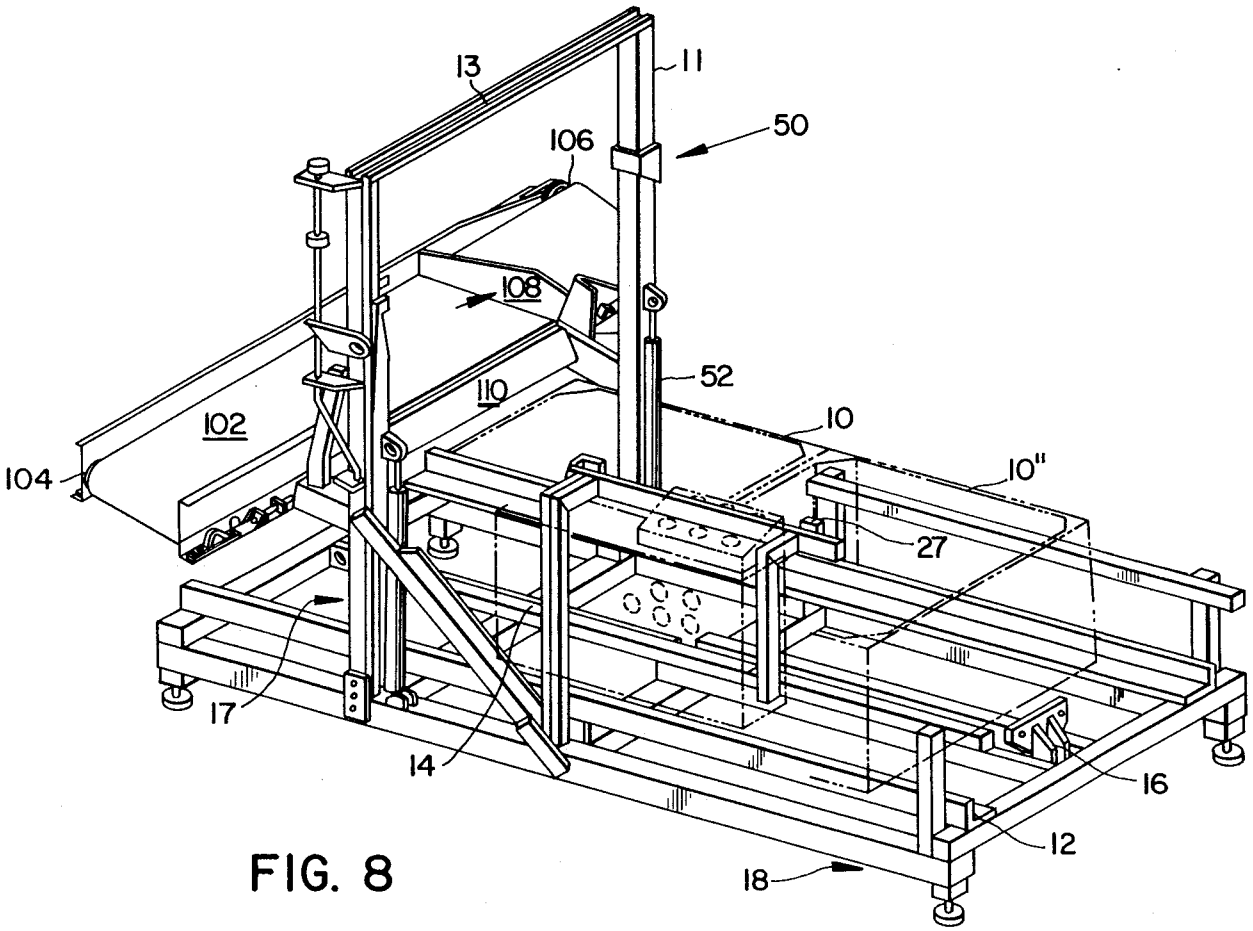
FIG. 8 illustrates an alternative embodiment of the present invention that employs a twisted conveyor assembly.

Referring now to FIG. 8, a further embodiment of the invention is shown in which the distributing conveyor 40, with an inclined conveyor belt 41, and the bumper conveyor 46 is replaced with a twisted conveyor assembly 100. The overall operation of the apparatus remains the same as described above with the exception of the replacement of the distributing conveyor 40 and bumper conveyor 46. The carriage 60 has been removed from FIG. 8 to clearly illustrate the position of the twisted conveyor assembly 100 with respect to the tower 17 and bed 18.

The twisted conveyor assembly 100 includes a continuous conveyor belt 102 wrapped around a horizontal roller 104 and an inclined roller 106. A baffle 108 is provided across the top surface of the continuous conveyor belt 102 to channel fruit through a side discharge opening 116, across the shoe 110 and into contact with the padded baffle 67 (not shown in FIG. 8). A more detailed view of the twisted conveyor assembly 100 is shown in FIGS. 9 and 10.

Figure 9:
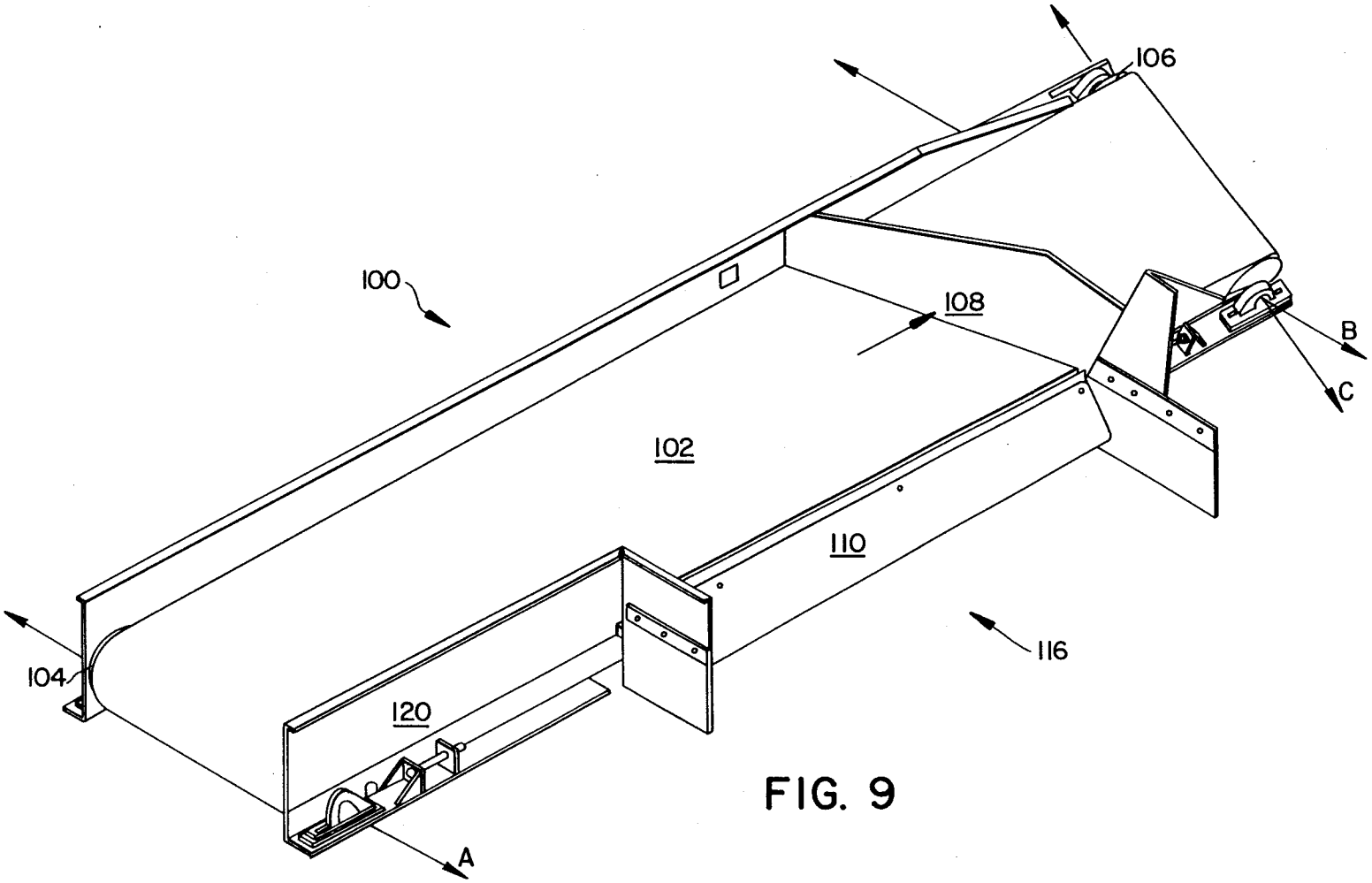
FIG. 9 is a perspective view of the twisted conveyor assembly illustrated in FIG. 8.
Figure 10:
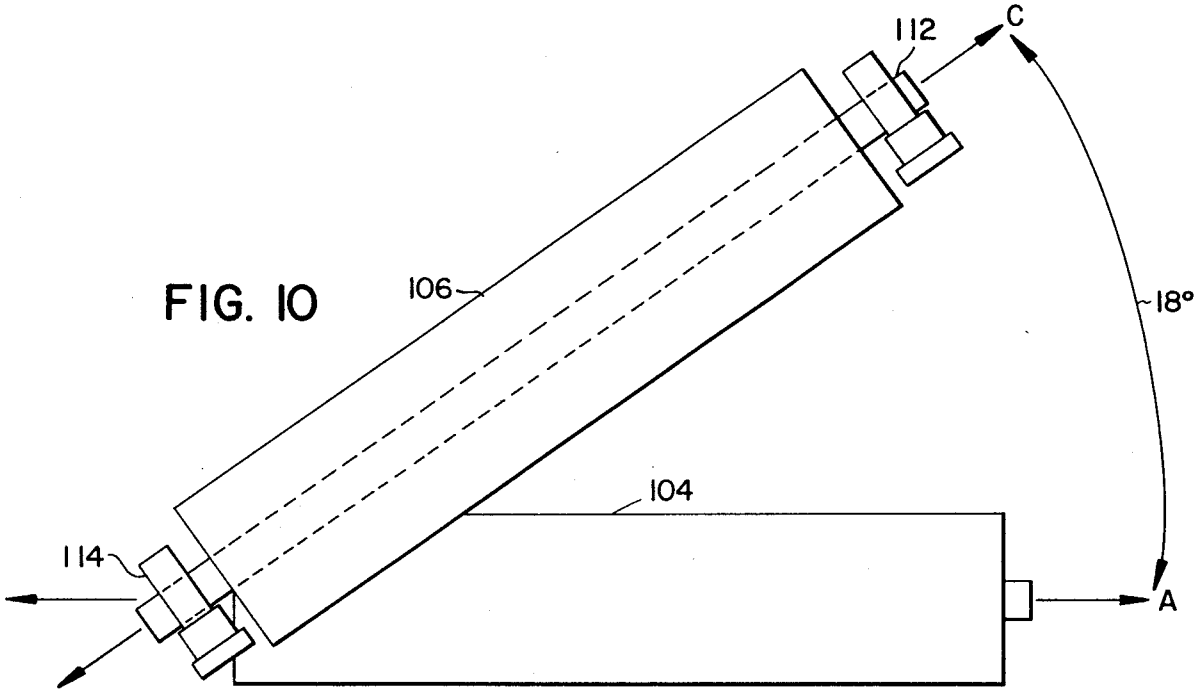
FIG. 10 illustrates the positional relationship of a horizontal roller and an inclined roller of the twisted conveyor assembly illustrated in FIG. 9.

Referring first to FIG. 9, the horizontal roller 104 rotates about an axis (A) which is substantially perpendicular to the tower 17. The inclined roller 106 rotates about an axis (C) which is inclined from an axis (B) by an angle of preferably about 18°, although other angles are of course possible based on the particular application, wherein axis (B) is parallel to and co-planar with axis (A). The positional relationship of the inclined roller 106 to the horizontal roller 104 imparts a twist in the continuous conveyor belt 102, causing fruit to move towards the side discharge 116 opening and across the shoe 110 in a gentle manner.

Figure 11:
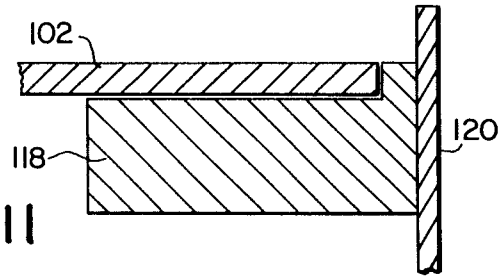
FIG. 11 is a cross-sectional view of a portion of the conveyor path for the twisted conveyor assembly illustrated in FIG. 9.

An additional feature of the twisted conveyor assembly is shown in FIG. 11, which illustrates a cross-sectional view of a portion of travel path for the conveyor belt 102. A belt slide 118 is provided having a raised portion 120 of a height substantially equal to the thickness of the conveyor belt 102. The belt slide 118 is preferably made of UHMW plastic and is located such that the raised portion 120 substantially fills the space between the edge of the conveyor belt 102 and a side 122 of the twisted conveyor assembly 100 from which the fruit is discharged. Preferably, the belt slide 118 runs along the entire length of the conveyor assembly 100 and prevents fruit from being cut by the edge of the conveyor belt 102. The belt slide 118 may of course be incorporated for use with conveyor 40 as well as the twisted conveyor assembly 100.

The present invention will find use in any industry where quantities of delicate fruit must be packed for a period of time in storage. Under those circumstances it is not cost effective to pack in small market shipment containers where the lack of ability to inspect the fruit prior to actual shipment to market necessitates the unpacking of all of the fruit for sorting out of deteriorated fruit and then repacking. At the same time because of sometimes prolonged periods of storage, it is imperative to pack delicate fruit in their large storage bins in the least damaging way and with the greatest of efficiency in time and material effort. This invention meets all of those needs by relatively inexpensively packing delicate fruit in large storage containers with a minimum of damage to the fruit during the packing operation. In addition, this invention will find application in the fruit and vegetable packing industries wherever relatively inexpensive equipment which is easy to maintain and very simple to operate and relatively compact will be of use. Further, the invention is not limited to the packaging of fruit and vegetables, but may also be employed to pack other objects which require delicate handling to avoid damage.

The invention has been described with reference to certain preferred structural and functional embodiments. It will be understood, however, that the invention is not limited to the specific embodiments shown, since the means and construction and method herein disclosed comprise but a preferred form of putting the invention into effect. This invention is, therefore, claimed in any of its forms or modifications within the legitimate and valid scope of the appended claims.

What is claimed is:

1. An apparatus for loading objects comprising:

a. a tower and a bed, said bed including transport means for moving at least one container past a loading location;

b. a carriage that is vertically movable from a maximum upper position and a maximum lower position within a frame work of said tower;

c. a twisted conveyor means comprising a twisted and inclined portion for dispensing said objects from a discharge opening positioned adjacent said loading location;

d. means for moving said carriage between said maximum upper position and said maximum lower position;

e. a cradle rotatable engaged to a portion of said carriage along an axis of rotation parallel to the plane of vertical movement of said carriage, wherein said cradle is rotatable about said axis of rotation between a maximum rearward position and a maximum forward position, said cradle including a baffle having a width slightly less than the width of said container;

f. means for rotating said cradle between said maximum rearward position and said maximum forward position;

g. control means for coordinating the independent motions of said carriage, said cradle and the movement of said container past said loading location in order to load said objects into said container, by controlling the operation of said means for moving said carriage, said means for rotating said cradle and said transport means.

2. An apparatus as set forth in claim 1, wherein said control means controls the operation of said means for moving said carriage, said means for rotating said cradle and said transport means, such that at the beginning of a loading cycle said container is placed at said loading position, said carriage is moved to its maximum upper position, and said cradle is rotated to its maximum forward position to place a forward lower edge of said baffle substantially adjacent to said discharge opening of said twisted conveyor, and thereafter the carriage and cradle descend downward together substantially to the bottom of said container in response to the arrival of said objects across a forward edge of said container to thereby permit a gradual filling of a forward portion of said container delineated by the forward wall of said container and the forward surface of said baffle, and said cradle is thereafter rotated rearward in proportion to the arrival of additional objects across said forward edge of said container until said cradle reaches said maximum rearward position, whereupon said cradle and said carriage are raised vertically together to said maximum upward position of said carriage and said container is transported forward by said transport means to pass beneath said twisted conveyor assembly causing objects to roll into said container until said container is nearly completely filled, whereupon said cradle means is rotated to its maximum forward position so that said lower forward edge of said baffle is substantially adjacent to said discharge opening of the twisted conveyor to cut off the flow of objects into said container.

3. An apparatus as claimed in claim 1, wherein said twisted conveyor means further comprises a continuous conveyor belt wrapped around a horizontal roller adapted to rotate about a first axis in a substantially horizontal plane, and an inclined roller adapted to rotate about a second axis, wherein said second axis is inclined with respect to said substantially horizontal plane.

4. An apparatus as claimed in claim 3, wherein said inclined roller is inclined at an angle of about 18° from said horizontal plane.

5. An apparatus as claimed in claim 3, further comprising at least one belt slide on which said conveyor belt rides, said belt slide having a raised portion at one edge thereof having a height substantially equal to the thickness of said conveyor belt.

6. An apparatus for loading objects into a container at a loading location, said apparatus comprising:

a. a tower assembly;

b. a carriage that is vertically movable from a maximum upper position and a maximum lower position on said tower assembly;

c. a conveyor assembly including a discharge opening positioned adjacent said loading location;

d. a cradle assembly at least partly positionable within said container and comprising a first member rotatably engaged at one end thereof to a portion of said carriage along its axis of rotation parallel to the plane of vertical movement of said carriage and further comprising a second member fixedly secured at an angle to said first member at another end thereof, wherein said cradle assembly is rotatable about said axis of rotation between a maximum rearward position and a maximum forward position; and e. control means for moving said carriage between said maximum upper position and said maximum lower position and for rotating said cradle between said maximum rearward position and said maximum forward position.

7. An apparatus as set forth in claim 6, wherein said control means controls the movement of said carriage and said cradle assembly such that at the beginning of a loading cycle, said carriage is moved to its maximum upper position and said cradle assembly is rotated to its maximum forward position to place a portion of said second member substantially adjacent to said discharge opening of said conveyor assembly, thereafter said carriage and cradle assembly descend downward together substantially to the maximum lower position of said carriage, and said cradle assembly is thereafter rotated rearward until said cradle assembly reaches said maximum rearward position, whereupon said cradle assembly and said carriage are raised vertically together to said maximum upward position of said carriage and thereafter said cradle assembly is rotated to its maximum forward position.

8. An apparatus as claimed in claim 6, wherein said conveyor assembly comprises a twisted conveyor.

9. An apparatus as claimed in claim 8, wherein said twisted conveyor comprises a continuous conveyor belt wrapped around a horizontal roller adapted to rotate about a first axis in a substantially horizontal plane, and an inclined roller adapted to rotate about a second axis, wherein said second axis is inclined with respect to said substantially horizontal plane.

10. An apparatus as claimed in claim 9, wherein said inclined roller is inclined at an angle of about 18° from said horizontal plane.

11. An apparatus as claimed in claim 6, wherein said conveyor assembly includes a conveyor belt and at least one belt slide on which said conveyor belt rides, said belt slide having a raised portion at one edge thereof having a height substantially equal to the thickness of said conveyor belt.

12. An apparatus as claimed in claim 7, wherein said portion of said second member to be placed adjacent to said discharge opening comprises a baffle.

13. An apparatus for loading objects comprising:

a. a tower and a bed, said bed including transport means for moving at least one container past a loading location;

b. a carriage that is vertically movable from a maximum upper position and a maximum lower position within a frame work of said tower;

c. a conveyor assembly including a discharge opening positioned adjacent said loading location;

d. means for moving said carriage between said maximum upper position and said maximum lower position;

e. a cradle at least partly positionable within said container and comprising a first member rotatable engaged at one end thereof to a portion of said carriage along its axis of rotation parallel to the plane of vertical movement of said carriage and further comprising a second member fixedly secured at an angle to said first member at another end thereof, wherein said cradle is rotatable about said axis of rotation between a maximum rearward position and a maximum forward position, said second member including a baffle having a width slightly less than the width of said container;

f. means for rotating said cradle between said maximum rearward position and said maximum forward position;

g. control means for coordinating the independent motions of said carriage, said cradle and the movement of said container past said loading location in order to load said objects into said container.

* * * * *